United States Patent [19]

Hagiwara et al.

[11] Patent Number: 4,907,468

[45] Date of Patent: Mar. 13, 1990

[54] PEDAL EFFORT-REDUCTION APPARATUS

[75] Inventors: Yoshihiko Hagiwara, Sagamihara; Katsumi Ooshima, Yokohama, both of Japan

[73] Assignee: Topre Corporation, Tokyo, Japan

[21] Appl. No.: 111,613

[22] Filed: Oct. 23, 1987

[30] Foreign Application Priority Data

Nov. 14, 1986 [JP] Japan ..... 61-174861[U]
Nov. 14, 1986 [JP] Japan ..... 61-174862[U]

[51] Int. Cl.[4] ..... G05G 1/14

[52] U.S. Cl. ..... 74/512; 74/518; 74/560

[58] Field of Search ..... 74/512, 518, 560; 192/995

[56] References Cited

U.S. PATENT DOCUMENTS 3,199,367 4/1963 Zetye ..... 74/512
3,302,763 11/1964 Wobrock ..... 192/995

FOREIGN PATENT DOCUMENTS 51-35863 9/1976 Japan .
58-6629 1/1983 Japan .
58-113124 8/1983 Japan .
61-39635 3/1986 Japan .
61-76727 5/1986 Japan .

*Primary Examiner*—Gary L. Smith
*Assistant Examiner*—F. Saether
*Attorney, Agent, or Firm*—Oblon, Spivak, McClelland, Maier & Neustadt

[57] ABSTRACT

A pedal effort-reduction apparatus according to the present invention comprises a pedal arm and a lever which is movable as one therewith. First and second torsion coil springs are provided between the lever and a support bracket. The first coil spring urges the pedal arm to return to its initial position before the arm, starting from the initial position, reaches a position at a predetermined rotational angle to the initial position. When the pedal passes the predetermined-angle position, the first spring begins to urge the pedal arm in the direction in which it is being pushed. The second spring is attached to the lever so as to urge the pedal arm only in the direction in which it is being pushed. Therefore, when the pedal arm is pushed past the predetermined-angle position, the repulsive force generated by both the first spring and the second spring then acts as a pedal effort-reduction force.

1 Claim, 8 Drawing Sheets

PEDAL EFFORT-REDUCTION APPARATUS

FIELD OF THE INVENTION

The present invention relates to an apparatus for reducing the treading force required to operate a pedal, such as the clutch pedal of an automobile. More specifically, the present invention relates to an improvement of the means for urging the pedal.

BACKGROUND OF THE INVENTION

One consequence of the recent development of higher-output engines is that the repulsive force generated by the clutch springs has become much greater, so that the effort required to operate the clutch pedal has increased correspondingly. Not surprisingly, there is now considerable demand for an apparatus able to provide the maximum reduction possible in the pedal effort.

In conventional pedal effort-reduction apparatuses, a torsion coil spring is used as the means for urging the pedal. One such apparatus is disclosed in Japanese Utility Model Disclosure No. 62-18720.

In this prior art apparatus, a horizontal support shaft is attached to a support bracket, and the support shaft is fixed to a car body. A movable pedal arm is mounted on the shaft, and the movable pedal arm has a lever which moves as one therewith. A torsion coil spring is arranged under an initial torsional moment between the free end of the lever and the support bracket. The first end of the sping is rotatably supported on the bracket, while the second end thereof is secured to the lever. Before the pedal is operated, the second end of the spring is located on the pedal-return side of a segment which connects the center of the support shaft and the first end of the spring.

Thus, in the case of the apparatus with the aforementioned construction, when the pedal arm is pushed in by being trod on, the repulsive force generated the spring urges the pedal arm to return before the second end of the spring reaches the segment connecting the center of the support shaft and the first end. However, when the pedal arm moves to a position such that the second end passes the connecting segment, the repulsive force of the spring then begins urging the arm to move in the direction in which it is being pushed. As a result, the effort required to operate the pedal can be reduced.

If, in the prior art apparatus described above, a torsion coil spring having a larger spring constant or a longer lever is used so as to reduce the pedal effort, then the repulsive force generated by the spring acting on the pedal arm is correspondingly increased, with the result that the effort required in the initial stage of pedal operation is greater. Thus, the prior art pedal cannot, initially at least, be operated with ease.

OBJECT OF THE INVENTION

Accordingly, the object of the present invention is to provide a means by which the initial effort necessary to operate a pedal can be reduced and which also enables a further reduction in pedal effort after a so-called cross-over point has been passed.

SUMMARY OF THE INVENTION

According to the present invention, a pedal effort-reduction apparatus is provided for reducing the treading force required to operate a pedal. The apparatus comprises a support bracket including a pair of side plates. A horizontal support shaft extends between the side plates. A pedal arm is rotatably supported on the support bracket by means of the support shaft. A lever is movable as one with the pedal arm. A first torsion coil spring is mounted between the lever and the support bracket. The first torsion coil spring has a first end, movably supported by one side plate of the support bracket and a second end secured to the lever so as to apply an initial torsional moment to the first spring. The second end of the first torsion coil spring is located on the pedal-return side of a segment connecting the center of the support shaft and the first end before the pedal is operated. The first torsion coil spring is adapted to urge the pedal arm in the returning direction thereof before the second end reaches the segment and to begin urging the pedal arm in the direction in which it is being pressed when the second end passes the aforesaid segment; and a second torsion coil spring is mounted between the support bracket and the lever. The second torsion coil spring has a first end supported by the support bracket and a second end supported by the lever. The second end of the second torsion coil spring is located in the vicinity of or on the pedal-operation side of a segment connecting the center of the support shaft and the first end of the second torsion coil spring, in order to urge the pedal arm in the direction in which it is being pushed.

In the apparatus of the invention, when the pedal arm is pushed in until it reaches a position at a predetermined rotational angle, the pedal arm is urged by the repulsive force generated by the first torsion coil spring to return to its initial position. In contrast, the repulsive force of the second torsion coil spring urges the pedal arm in the direction in which it is being pushed throughout the range of movement of the pedal. The effort required in the initial stage of pedal operation can be reduced because, when the pedal arm passes the predetermined angle, the first and second torsion coil spring then both urge the pedal arm in the direction in which it is being pushed. As a result, the overall effort required to operate the pedal can be reduced.

BRIEF DESCRIPTION OF THE DRAWINGS

FIG. 4 is a side view of the apparatus shown in FIG. 1, in which the pedal arm is forced in;

FIG. 14 is a side view of the apparatus shown in FIG. 11, in which the pedal arm is forced in;

DETAILED DESCRIPTION OF THE PREFERRED EMBODIMENTS

The First Embodiment

Figure 1:
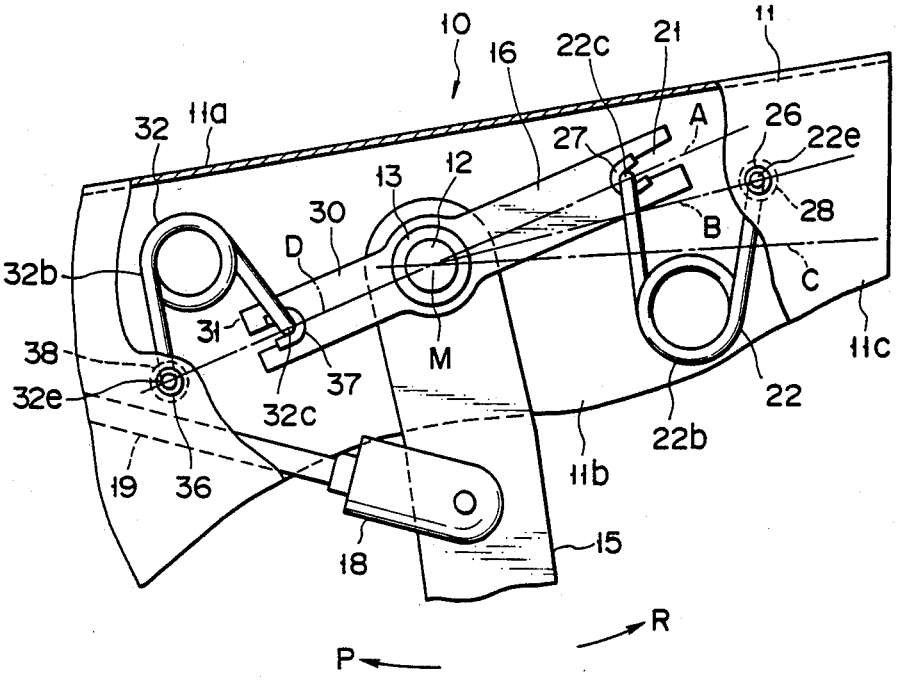
FIG. 1 is a side view of a pedal effort-reduction apparatus according to a first embodiment of the present invention.
Figure 2:
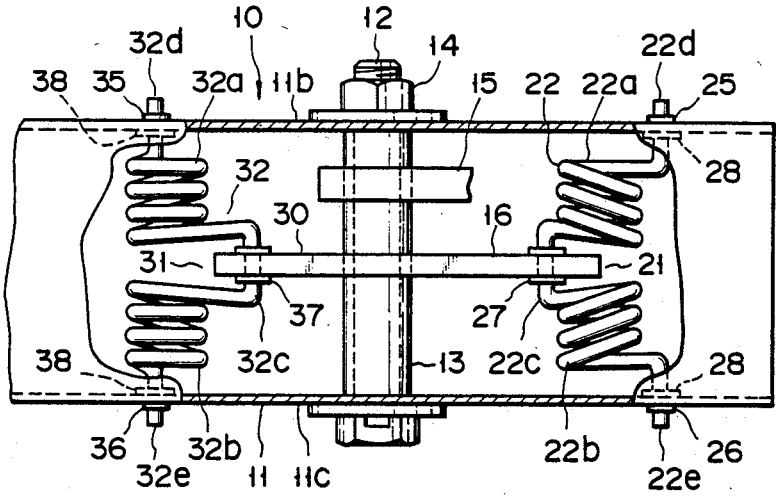
FIG. 2 is a plan view of the apparatus shown in FIG. 1.

FIGS. 1 to 4 show a first embodiment of the present invention. Referring now to FIG. 1, there is shown a pedal effort-reduction apparatus 10 in which a support bracket 11 is fixed to a car body (not shown). The support bracket 11 includes a top plate 11*a* and a pair of side plates 11*b* and 11*c*. A horizontal support shaft 12 having a center M stretches between the side plates 11*b* and 11*c*. A cylindrical body 13 is mounted on the horizontal support shaft 12 so as to be rotatable around the shaft.

A pedal arm 15 and a lever 16 are fixed to the cylindrical body 13. One end of a push rod 19 is coupled to the pedal arm 15 by means of a clevis 18. A master buck (not shown) is connected to the other end of the push rod 19. It has functions to engage or disengage a clutch plate (not shown) and to restore the pedal arm 15 to its original position after it has been rocked. The lever 16 has a notch 21.

A first torsion coil spring 22 is provided between the notch 21 and the support bracket 11. The first torsion coil spring 22 includes a symmetrical pair of coils 22*a* and 22*b* and second end portions 22*c* connecting the coils 22*a* and 22*b*. The coils 22*a* and 22*b* have first end portions 22*d* and 22*e*, respectively. The first end portions 22*d* and 22*e* are inserted in holes 25 and 26 bored through side plates 11*b* and 11*c*, respectively. The second end portions 22*c* are fitted in notch 21 of the lever 16. A plastic spacer 27 is interposed between the inner surface of the notch 21 and the second end portions 22*c*. Also, spacers 28 are interposed individually between the inner surface of the hole 25 and the first end portion 22*d* and between the inner surface of the hole 26 and the first end portion 22*e*.

The first torsion coil spring 22 is attached to the holes 25 and 26 and to the notch 21 under an initial torsional moment such that the distance between the first end portions 22*d* and 22*e* and the second end portions 22*c* is shorter than in a free state. When no treading force is applied to the pedal arm 15, the second end portions 22*c* are situated in a position A on the pedal-return side of a segment B which connects the center M (see FIG. 1) of the horizontal support shaft 12 and the first end portion 22*d* or 22*e*.

Moreover, a second torsion coil spring 32 is interposed between a second portion 30 of the lever 16 and the support bracket 11. The second torsion coil spring 32, which is shaped like the first torsion coil spring 22, includes a symmetrical pair of coils 32*a* and 32*b* and second end portions 32*c* connecting the coils 32*a* and 32*b*. The coils 32*a* and 32*b* have first end portions 32*d* and 32*e*, respectively.

The first end portions 32*d* and 32*e* are rockably supported in holes 35 and 36 bored through the side plates 11*b* and 11*c*, respectively. Spacers 38 are interposed individually between the respective inner surfaces of the holes 35 and 36 and their corresponding first end portions 32*d* and 32*e*. The second end portions 32*c* are supported in a notch 31 cut in the second portion 30 of the lever 16. A spacer 37 is interposed between the inner surface of the notch 31 and the second end portions 32*c*.

The second torsion coil spring 32 is attached to the holes 35 and 36 and the notch 31 under an initial torsional moment such that the distance between the first end portions 32*d* and 32*e* and the second end portions 32*c* is shorter than in a free state. Before the pedal arm 15 is forced in, second end portions 32*c* are situated on position D (see FIG. 1) which connects the center M of the horizontal support shaft 12 and the first end portion 32*d* or 32*e*.

Figure 3:
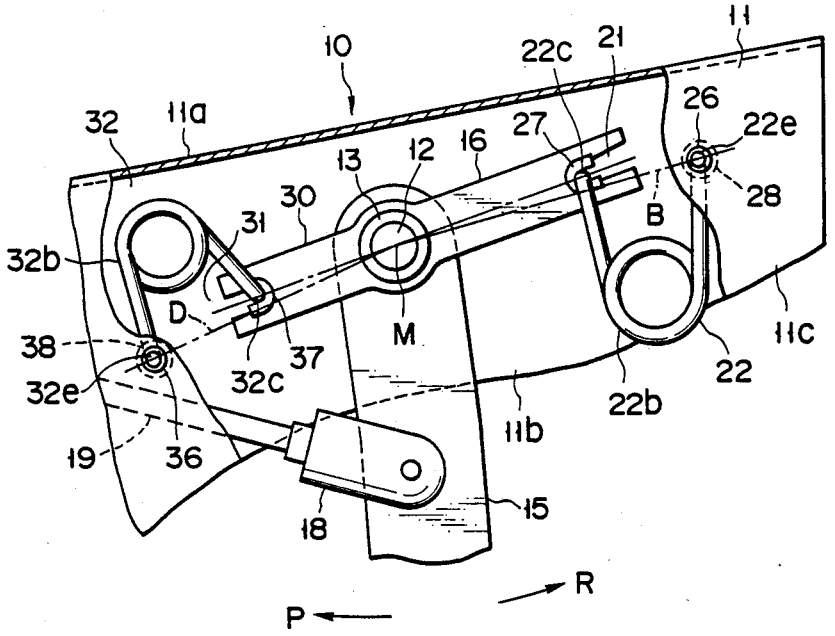
FIG. 3 is a side view of the apparatus shown in FIG. 1, in which a pedal arm is moved to its turnover point.
Figure 4:
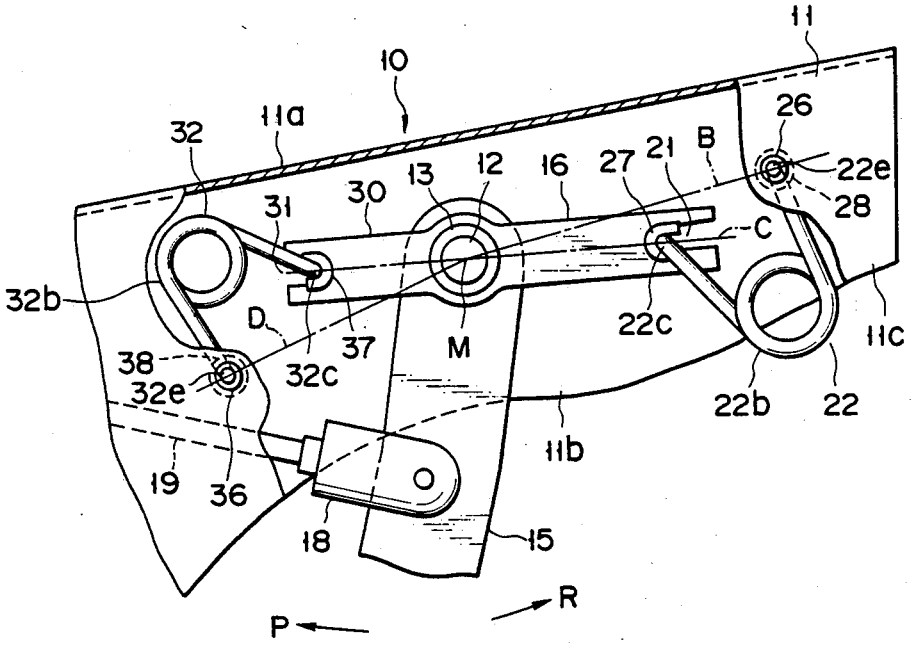

The operation of the pedal effort-reduction apparatus, constructed in this manner, will now be described. FIG. 1 shows a state before the pedal is worked, while FIG. 3 shows the state after the pedal is moved to its turnover point.

If the pedal arm 15 is forced down in the direction of an arrow P, from the position of FIG. 1, the pedal arm 15 and the lever 16 move in the direction of the arrow P around the horizontal support shaft 12. At the same time, the second end portions 22*c* of the first torsion coil spring 22 move from the initial position A toward the working position C, and the second end portions 32*c* of the second torsion coil spring 32 also move to the working side.

In this case, the repulsive force of first torsion coil spring 22 acts in the direction of an arrow R while the second end portions 22*c* are moving from the position A to the position B. When the second end portions 22*c* pass the position B, the repulsive force of the first torsion coil spring 22 acts in the direction of the arrow P. On the other hand, the repulsive force of the second torsion coil spring 32 does not substantially act when the pedal is not worked. When the pedal is worked, the repulsive force of the second torsion coil spring 32 acts only in the direction of the arrow P. Thus, a resultant force combining the respective resilient forces of the first and second torsion coil springs 22 and 32 serves as a force to lighten the pedal load.

Figure 6:
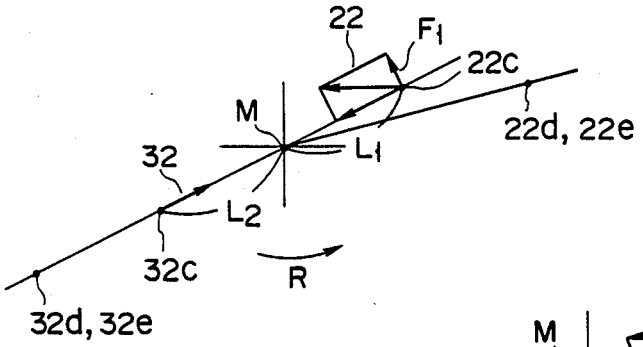
FIGS. 6, 7 and 8 are diagrams for illustrating the way component forces of the first and second springs vary depending on the position of the pedal arm.

Before the pedal is worked, a component $F_1$ of the resilient force of the first torsion coil spring 22 acts in the direction of the arrow R, as shown in FIG. 6, although the resilient force of the second torsion coil spring 32 does not act in any direction. At the start of the treading action on the pedal, therefore, a returning force acts on the pedal, and initial necessary pedaling force $R_0$ is given by $R_0=F_1\times L_1$, where $L_1$ is the distance between the center M of the horizontal support shaft 12 and the second end portions 22*c*.

Figure 7:
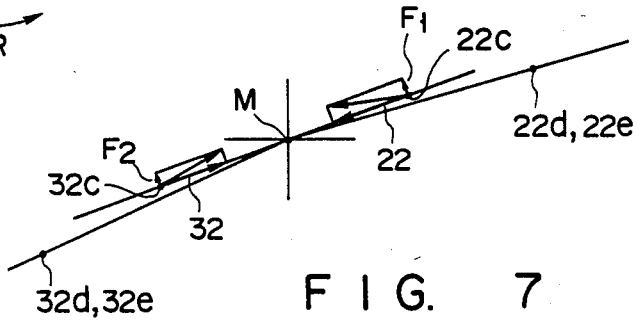

When the pedal arm 15 reaches its turnover point as the pedal is worked, a component force $F_2$ of the second torsion coil spring 32 acts as shown in FIG. 7. Acting in opposite directions, the component forces $F_1$ and $F_2$ cancel each other. Thus, the force acting on the pedal is given by $R=F_1\times L_1+F_2\times L_2=0$, where $L_2$ is the distance between the center M of the horizontal support shaft 12 and the second end portions 32*c*.

Figure 5:
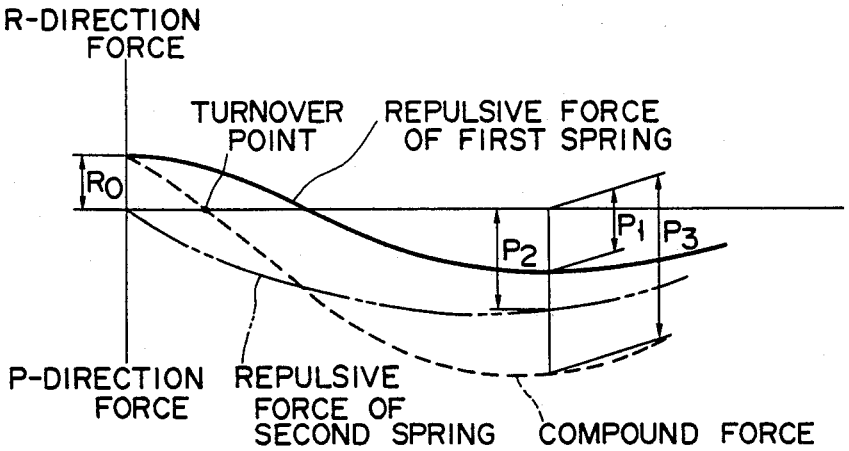
FIG. 5 is a diagram showing transitions of reaction forces of springs in the apparatus shown in FIG. 1.
Figure 8:
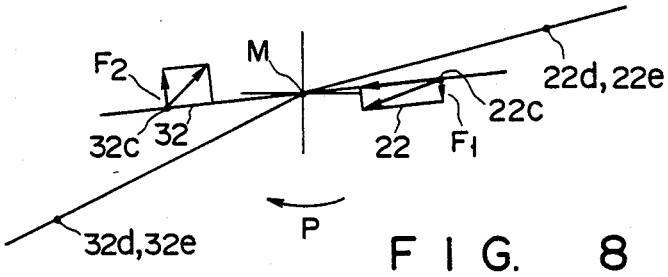

When the pedal arm 15 passes the turnover point as the pedal is worked further, the component forces $F_1$ and $F_2$ of the first and second torsion coil springs 22 and 32 act in the direction of the arrow P, as shown in FIG. 8. Thus, the force acting on the pedal i.e. the pedal effort-reduction force $P_3$, which is given by $P_3=F_1\times L_1+F_2\times L_2$, is great. The force $P_3$ is a resultant force combining the forces $P_1$ and $P_2$ produced by the first and second torsion coil springs 22 and 32, respectively, as indicated by a broken line in FIG. 5.

According to the first embodiment described above, the initial necessary treading force can be reduced, and the pedal effort-reduction force obtained after the passage through the turnover point can be made greater. Also, an optimum pedal effort-reduction force can be obtained depending on the length of the lever 16 and the second portion 30. Moreover, since the first and second torsion coil springs 22 and 32 are arranged on opposite sides of the horizontal support shaft 12, the repulsive forces of the first and second torsion coil springs 22 and 32, acting in the radial direction of the horizontal support shaft 12, can be balanced with each other. Thus, a frictional force acting between the horizontal support shaft 12 and the cylindrical body 13 can be reduced.

The lever 16 and the second portion 30 may alternatively be formed on part of the pedal arm 15.

The Second Embodiment

Figure 9:
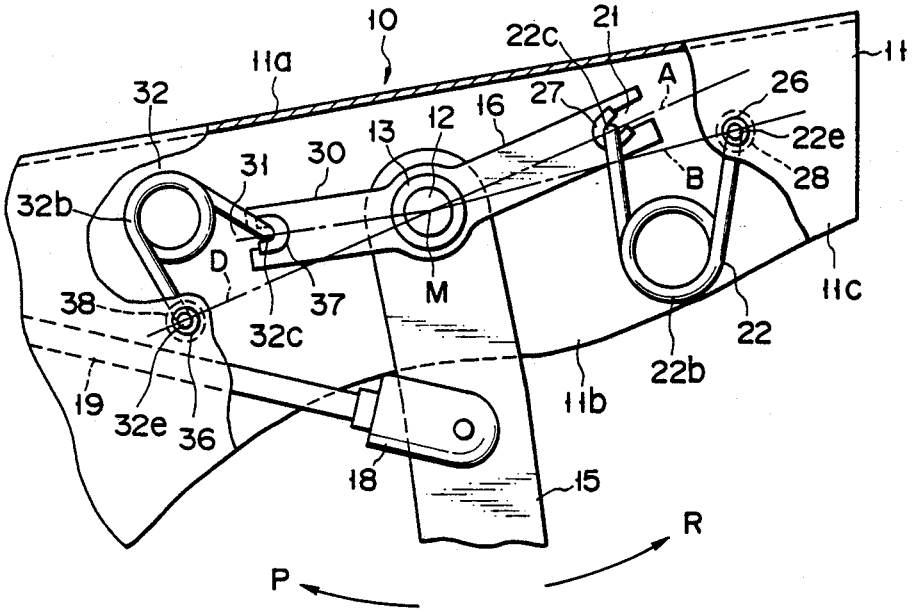
FIG. 9 is a side view of a pedal effort-reduction apparatus according to a second embodiment of the invention.
Figure 10:
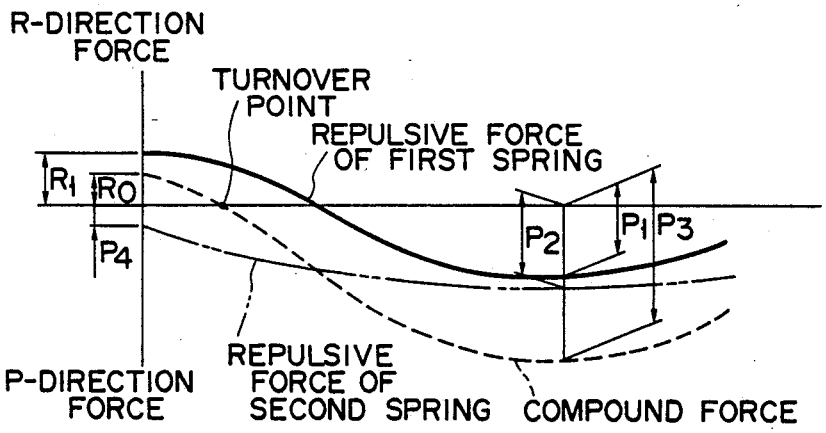
FIG. 10 is a diagram showing transitions of reaction forces of springs in the apparatus shown in FIG. 9.

FIG. 9 shows a second embodiment of the present invention. Before the pedal arm 15 is worked, in this embodiment, the second end portions **32*c* of the second torsion coil spring 32 are situated on the pedal-working side of a segment D which connects the center M of the horizontal support shaft 12 and the first end portion 32*d* or 32*e*. Accordingly, the repulsive force of the second torsion coil spring 32 acts in the direction of the arrow P throughout the range of the rocking action of the pedal. As shown in FIG. 10**, therefore, the initial necessary pedaling force $R_0$ can be made smaller than in the first embodiment.

The Third Embodiment

Figure 11:
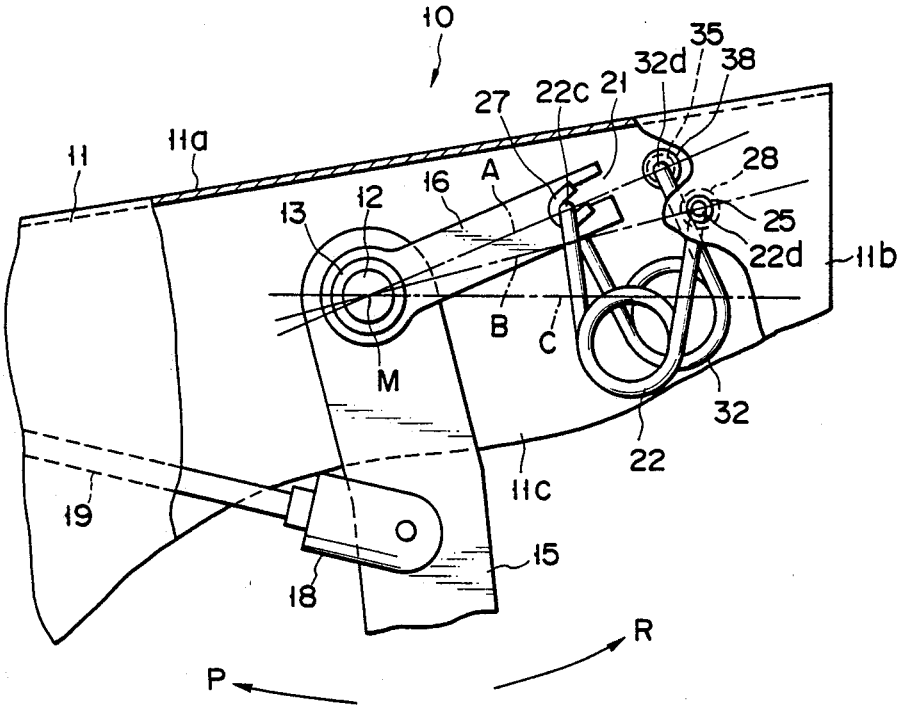
FIG. 11 is a side view of a pedal effort-reduction apparatus according to a third embodiment of the invention.
Figure 12:
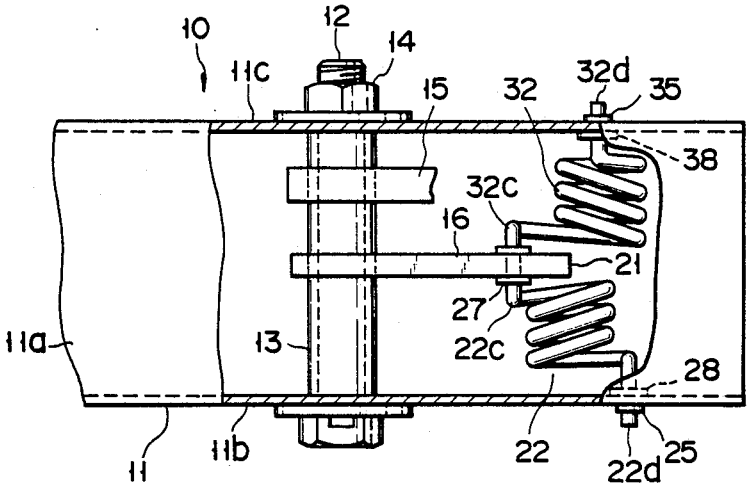
FIG. 12 is a plan view of the apparatus shown in FIG. 11.

FIGS. 11 to 15 show a third embodiment of the present invention. In this embodiment, the first and second torsion coil springs 22 and 32, made of a single spring wire, are coiled adjacent to each other. The first end portions **22*d* and 32*d* are supported in holes 25 and 35 bored through side plates 11*b* and 11*c*, respectively, while the second ends 22*c* and 32*c* are fitted in the notch 21 of the lever 16. The first torsion coil spring 22 is attached to the hole 25 and to the notch 21 under an initial torsional moment such that the distance between the first and second end portions 22*d* and 22*c* is shorter than in a free state. Before the pedal arm 15 is forced in, as shown in FIG. 11, the second end portion 22*c* of the first torsion coil spring 22 is situated in the position A on the pedal-return side of the segment B which connects the center M of the horizontal support shaft 12 and the first end portion 22*d*. When the pedal arm 15 moves in the direction of the arrow P, the second end portion 22*c*** moves from the initial position A toward the working position C through the neutral position B.

On the other hand, the second torsion coil spring 32 is attached to the hole 35 and to the notch 21 under an initial torsional moment such that the distance between the first and second end portions **32*d* and 32*c* is shorter than in a free state. Before the pedal arm 15 is forced in, the second end portion 32*c* of the second torsion coil spring 32** is situated on the segment A.

Figure 13:
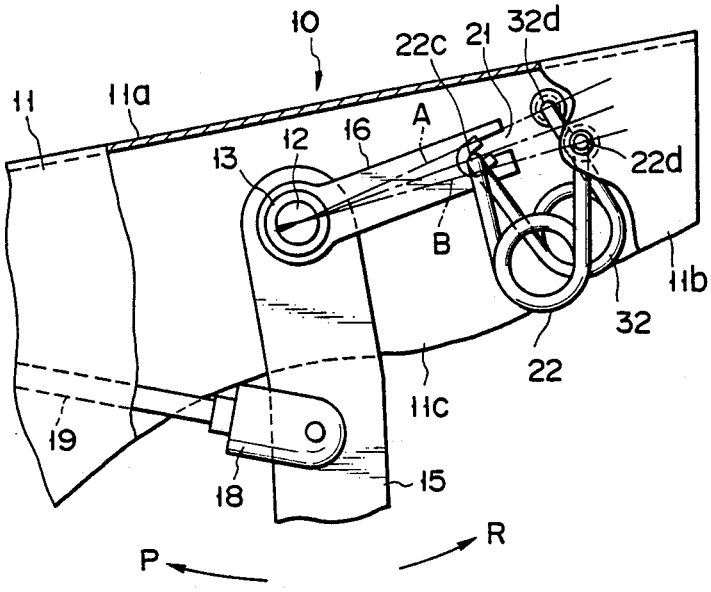
FIG. 13 is a side view of the apparatus shown in FIG. 11, in which a pedal arm is moved to its turnover point.
Figure 14:
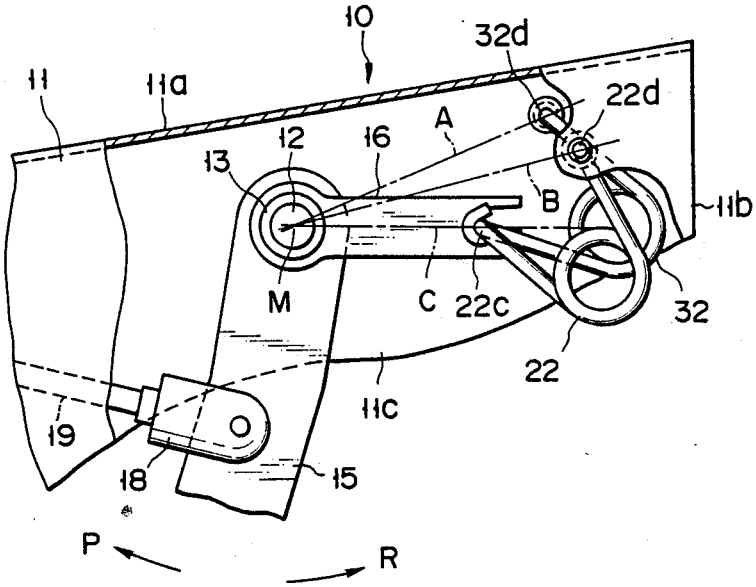
Figure 15:
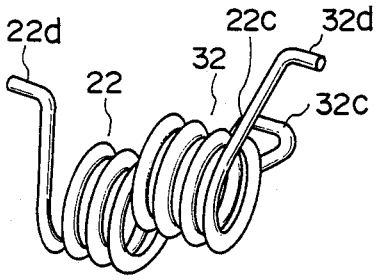
FIG. 15 is a perspective view of a spring used in the apparatus shown in FIG. 11.

The operation of the third embodiment, constructed in this manner, will now be described. FIG. 11 shows the state before the pedal is worked, while FIG. 13 shows the state after the pedal is moved to its turnover point.

Figure 16:
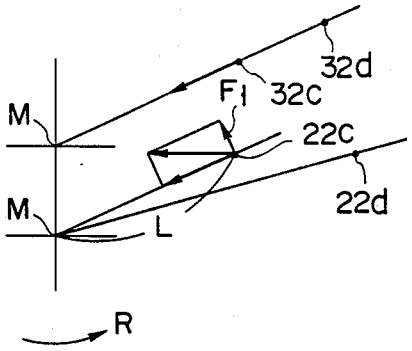
FIGS. 16, 17 and 18 are diagrams for illustrating the way component forces of first and second springs vary depending on the position of the pedal arm.

If the pedal arm 15 is forced down in the direction of the arrow P from the position of FIG. 11, the repulsive force of the first torsion coil spring 22 acts in the direction of the arrow R while the second end portions **22*c* is moving from the position A to the position B. When the second end portion 22*c* passes the position B, the repulsive force of the first torsion coil spring 22 acts in the direction of the arrow P. On the other hand, the repulsive force of the second torsion coil spring 32 does not substantially act when the pedal is not worked. When the pedal is worked, the repulsive force of the second torsion coil spring 32 acts in the direction of the arrow P. Thus, the force $R_0$ acting in the direction of the arrow R at the start of the treading action on the pedal, as shown in FIG. 16, is given by $R_0=F_1\times L$, where L is the distance between the center M and the second end portion 22*c***.

Figure 17:
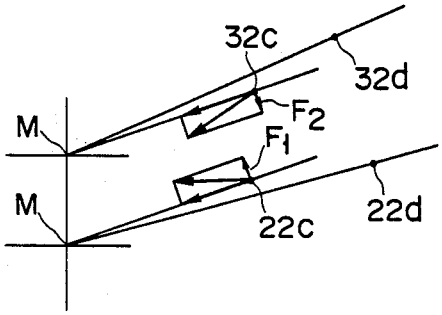

When the pedal arm 15 reaches its turnover point as the pedal is worked, the component force $F_2$ of the second torsion coil spring 32 acts as shown in FIG. 17. Since the component forces $F_1$ and $F_2$ act in opposite directions, the force R acting on the pedal is canceled and is given by $R=F_1\times L+F_2\times L=0$.

Figure 18:
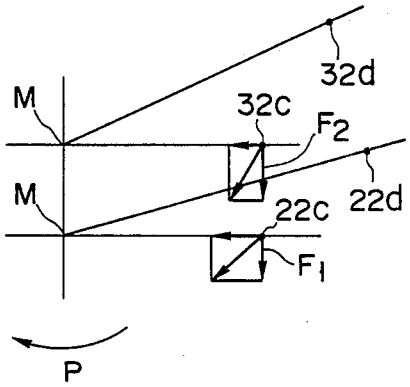
Figure 19:
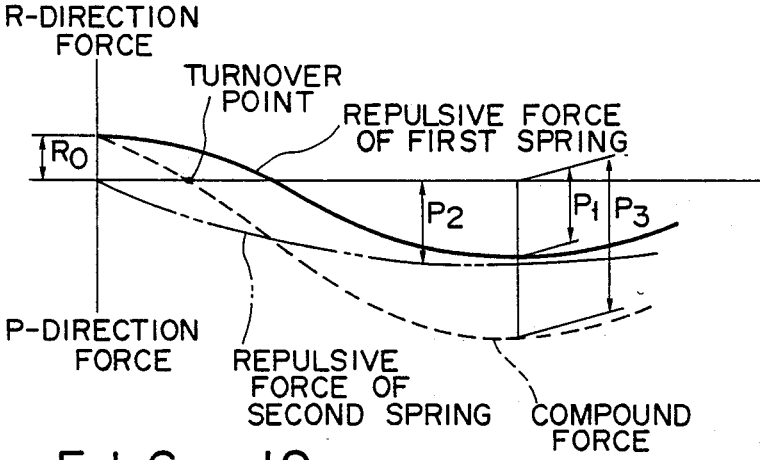
FIG. 19 is a diagram showing transitions of reaction forces of springs in the apparatus shown in FIG. 11.

When the pedal arm 15 passes the turnover point as the pedal is worked further, the component forces $F_1$ and $F_2$ of the and second torsion coil springs 22 and 32 act in the direction of the arrow P, as shown in FIG. 18. Thus, the pedal effort-reduction force $P_3$ (which is given by $P_3=F_1\times L+F_2\times L$) is great. The force $P_3$ is a resultant force combining the forces $P_1$ and $P_2$ produced by the first and second torsion coil springs 22 and 32, respectively, as indicated by a broken line in FIG. 19. According to the third embodiment constructed in this manner, the first and second torsion coil springs 22 and 32 are formed in one united body, so that the necessary number of parts of the apparatus can be smaller than in the case of the first embodiment.

The Fourth Embodiment

Figure 20:
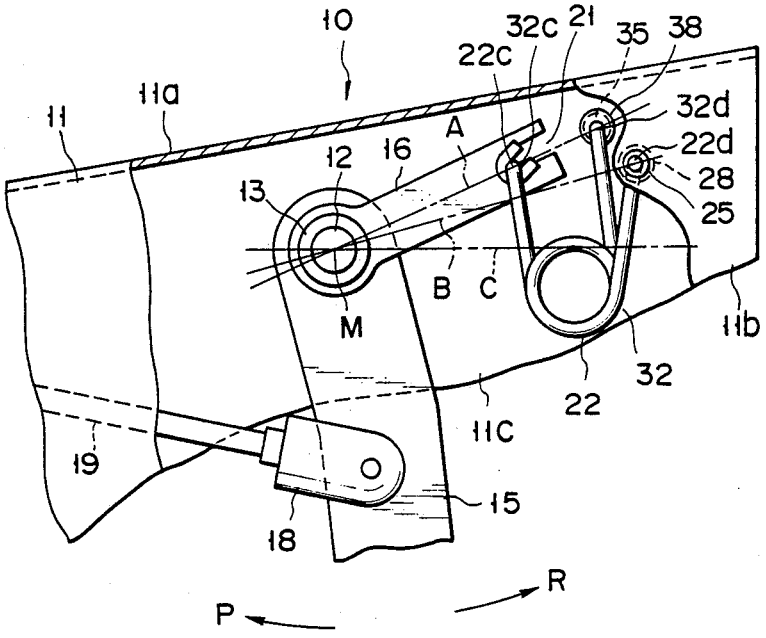
FIG. 20 is a side view of a pedal effort-reduction apparatus according to a fourth embodiment of the invention.
Figure 21:
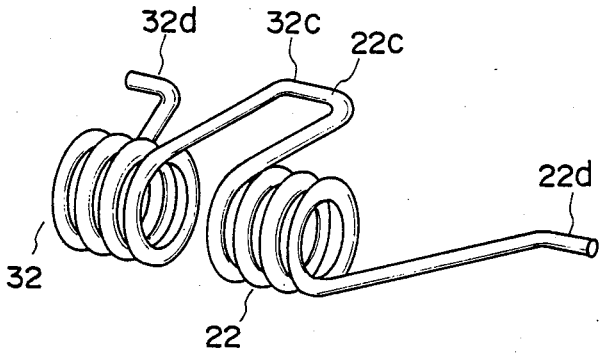
FIG. 21 is a perspective view of a spring used in the apparatus shown in FIG. 20.

In a fourth embodiment shown in FIGS. 20 and 21, first and second torsion coil springs 22 and 32 are coiled so as to be coaxial with each other. The second end portion **32*c* of the second torsion coil spring 32 is situated on the segment A which connects the center M of the horizontal support shaft 12 and the first end portion 32*d***. Thus, the fourth embodiment can provide the same function as the third embodiment.

In the third and fourth embodiments described above, the second end portion **32*c* of the second spring 32 may alternatively be situated on the pedal-working side of the segment A which connects the center M of the horizontal support shaft 12 and the first end portion 32*d*. In this case, the repulsive force of the second torsion coil spring 32** acts in the direction of the arrow P throughout the range of rocking action of the pedal. Accordingly, the initial necessary pedaling force can be reduced further.

What is claimed is:

1. A pedal effort-reduction apparatus for reducing the effort required to operate a pedal, said apparatus comprising:

(a) a support bracket including a pair of side plates;

(b) a horizontal support shaft extending between said side plates and having a center;

(c) a pedal arm rotatably supported on said support bracket by means of said support shaft;

(d) a lever movable as one with said pedal arm;

(e) a first torsion coil spring mounted between said lever and said support bracket, said first torsion coil spring having a first end which is movably supported by one side plate of said support bracket and a second end which is secured to said lever so as to apply an initial torsional moment to said first torsion coil spring, said second end of said first torsion coil spring being located on the pedal-return side of a first segment connecting the center of said horizontal support shaft and said first end of said first torsion coil spring before the pedal is operated, said first torsion coil spring being adapted to urge said pedal arm in the returning direction thereof before said second end of said first torsion coil spring reaches the first segment and to begin urging said pedal arm in the direction in which it is being pressed when said second end of said first torsion coil spring passes the first segment; and (f) a second torsion coil spring mounted between said support bracket and said lever, said second torsion coil spring having a first end which is supported by said support bracket and a second end which is supported by said lever, said second end of said second torsion coil spring being located in the vicinity of or on the pedal-operating side of a second segment connecting the center of said horizontal support shaft and said first end of said second torsion coil spring in order to urge said pedal arm in the direction in which it is being pressed, wherein:

(g) said first and second torsion coil springs are independent of each other and are located individually on opposite sides of said support shaft and (h) said second end of said second torsion coil spring is located in the vicinity of the second segment before the pedal is operated.

* * * * *